US006615833B2

(12) United States Patent
Bigelow

(10) Patent No.: US 6,615,833 B2
(45) Date of Patent: Sep. 9, 2003

(54) MASKAP

(76) Inventor: Joseph Henry Bigelow, P.O. Box 270, Upton, MA (US) 01568

( * ) Notice: Subject to any disclaimer, the term of this patent is extended or adjusted under 35 U.S.C. 154(b) by 0 days.

(21) Appl. No.: 09/974,604

(22) Filed: Nov. 27, 2001

(65) Prior Publication Data

US 2003/0098025 A1 May 29, 2003

(51) Int. Cl.[7] ..... A62B 18/08

(52) U.S. Cl. ..... 128/206.27; 128/206.12; 128/206.17; 128/206.24; 128/207.11; 128/207.17

(58) Field of Search ..... 128/206.27, 207.11, 128/207.17, 206.24, 205.25, 206.12, 206.17, 206.23; 2/209.18, 195.1, 173, 171.2, 171, 202, 206, 209.7, 209.11, 209.12, 209.13

(56) References Cited

U.S. PATENT DOCUMENTS 3,152,588 A * 10/1964 Rogowski ..... 128/206.12
4,296,746 A * 10/1981 Mason et al. ..... 128/201.12
4,796,621 A * 1/1989 Barle et al. ..... 128/206.19
5,492,116 A * 2/1996 Scarberry et al. ..... 128/205.25
5,503,167 A * 4/1996 Wilson et al. ..... 128/857
5,664,566 A * 9/1997 McDonald et al. .... 128/205.25
5,957,132 A * 9/1999 McDonald et al. .... 128/206.21
6,026,511 A * 2/2000 Baumann et al. ..... 128/201.17
6,176,239 B1 * 1/2001 Grove et al. ..... 128/201.15

* cited by examiner

*Primary Examiner*—Weilun Lo
*Assistant Examiner*—Michael Mendoza
(74) *Attorney, Agent, or Firm*—Nields & Lemack

(57) ABSTRACT

The maskap is a safety mask that is worn like a cap, It has a thin rubber liner (or airtight material) that covers the inside of the cap. The rubber liner forms a seal when worn as a mask. There are two plastic eye covers that are sealed to the cap, that when worn as a mask will let the user see through them. On the brim of the cap but under the fabric is a filter box. The filter box has two air tubes molded to it. The air tubes run up the front of the cap. The open ends of the air tubes are sealed with the rubber liner. When the maskap is worn as a mask the user will breath through the filter box. There are elastic bands that are sewn to the cap at three or more points to hold the maskap on.

2 Claims, 1 Drawing Sheet

MASKAP

FIELD OF THE INVENTION

This invention relates to a safety mask that is in the form of a cap. The cap is a mask when pulled down over the face, the user would have a quick way to protect their eyes and themselves from breathing dust, gases, smoke and germs. It would be basically for emergencies or short time use. The user would not have to carry a gas mask with them all they have to do is wear the maskap as a cap. The safety of having a mask to protect users would become more of a part of life.

SUMMARY OF THE INVENTION

This invention is a safety mask that is worn as a cap. When worn as a mask it protects the eyes from smoke, dust, gases or most other foreign particles. It also protects from breathing smoke, dust, gases or most other foreign particles. The words smoke, dust, gases and foreign particles are used broadly to describe many types of each. The cap is comprised of a filter on the brim of the cap. It has air tubes running up the front of the cap that are sealed with the thin inner rubber liner (or an airtight material) of the cap. The thin inner rubber liner is to form a good seal with the users face. The plastic eye covers would be sealed to the liner as well. The plastic eye covers are cutouts in the cap that provide vision when in use and possibly made from fog proof plastic. The cap is worn like a hat. The mask is held on with elastic straps to be pulled out of the cap by user and pulled over the back of the head as the mask is pulled over the face from top of forehead to under chin. There is an elastic band on the back of the cap to provide some adjustment of size.

Due to the tragedy of Sep. 11, 2001 it is a good idea to have something readily available that you could wear that you could pull over your face real quick in an emergency situation. This cap would cover your eyes and mouth and filter the air you breathe. You could wear the cap for years without using it; but if you needed something real quick, you could use the MASKAP. There will probably be some simple testing of design before manufacturing. I did a simple patent search and could not find anything close with these features. This is not a typical dust/gas mask, it is discreet and very handy in an emergency as it covers the whole face.

BRIEF DESCRIPTION OF DRAWINGS

Draftings: 3

Shows sealed plastic eye covers, filter box and air tubs.

FIG. 2 Side view

Shows elastic bands out as if worn as a mask.

FIG. 3 Inside view

Shows air tubes open end with edges sealed with rubber liner.

Shows airtight liner.

Shows elastic bands.

DESCRIPTION OF THE INVENTION

This description represents a maskap.

Figure 1:
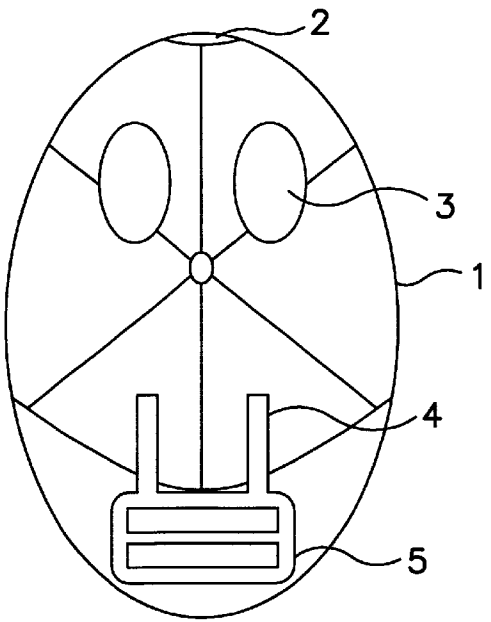
FIG. 1 Front view as a mask/top view as a cap

The front view, as a mask, or a top view, as a cap, is shown in FIG. 1.

Figure 3:
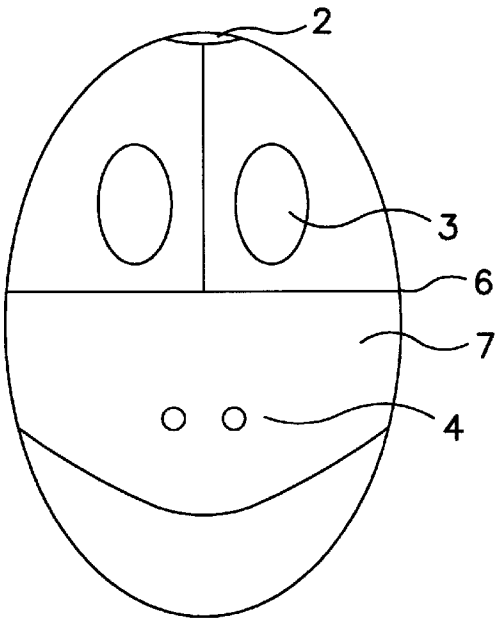
Figure 2:
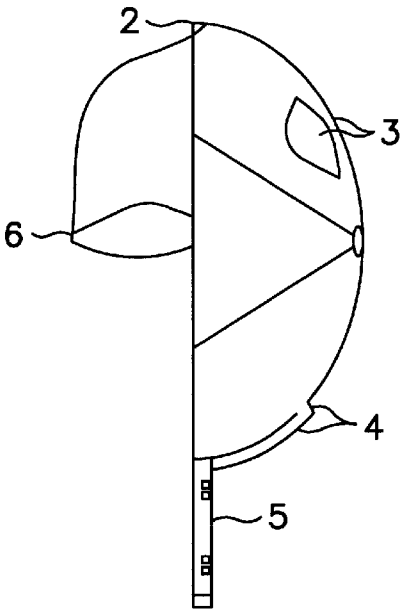

It shows a standard baseball like cap 1, as does FIGS. 2 & 3. The cap has an elastic back band 2 to allow for some size adjustment.

To allow the user to see when this invention is worn as a mask, there are two see through plastic eye covers 3 sealed into the cap.

FIG. 1. shows a filter box 5 and air tubes 4 running from the filter box 5 up the front of the cap. The filter box 5 is to house a filter and the air tubes 4 are to allow air to flow from outside the mask. The air tubes are sealed inside the mask to the thin rubber liner (or airtight material) 7 shown in FIG. 3, the inside view.

FIG. 2. shows a side view of the same invention, with the elastic straps 6 out as if being worn as a mask. The elastic straps 6 would be inside the cap when worn as a cap to conform to the shape of the inside of the cap.

FIG. 3. shows the mask from inside. The thin rubber liner cover the whole inside, except for cut outs for the eye covers 3 and the inlets for the air tubes 4. The rubber liner is to form a seal between the user's face and the outside. The main advantage of this invention is that it covers most, if not all, of the users face including eyes, nose and mouth. It also, if worn as a cap, is very quick and handy in an emergency that might include smoke, dust, gases and even some germs. It also could be carried in a pocket, bag or car. It does not have to be worn as a cap.

What I claim as my invention is:

1. A cap, suitable for use as a face mask, comprising:

a hemispherical shell configured to rest on a user's head, said shell having an inside surface, an outside surface and an inner cavity sufficiently sized to receive said user's head;

a protruding bill attached to a portion of said shell, said bill facing downward when said cap is in a substantially vertical position;

at least one transparent region in said shell, the location of said region corresponding to the location of said user's eyes when said cap is in said substantially vertical position over said user's face;

an elastic strap affixed to said circumference of said shell, said strap capable of holding said cap in said substantially vertical position over said user's face;

a flexible airtight material lining said inside surface of said shell; and a self-contained filtration system, said filtration system comprising air tubes connecting said cavity inside of said shell with a filter mounted on said bill.

2. The cap of claim 1, wherein said filter is capable of filtering gases, smoke, dust and germs.

* * * * *